United States Patent [19]

Kawaguchi

[11] Patent Number: 4,515,316

[45] Date of Patent: May 7, 1985

[54] METHOD OF WITHDRAWING PARTICULATE MATERIAL FROM DEAD-BED OF CENTRIFUGAL CRUSHER AND CENTRIFUGAL CRUSHER SUITABLE FOR CARRYING THE METHOD INTO PRACTICE

[75] Inventor: Mitsuru Kawaguchi, Kure, Japan

[73] Assignee: Kotobuki Engineering & Mfg Company, Ltd., Kure, Japan

[21] Appl. No.: 487,467

[22] Filed: Apr. 22, 1983

[30] Foreign Application Priority Data

Apr. 27, 1982 [JP] Japan ..... 57-71964

[51] Int. Cl.[3] ..... B02C 19/00

[52] U.S. Cl. ..... 241/5; 241/26; 241/275; 241/284

[58] Field of Search ..... 241/5, 40, 275, DIG. 10, 241/26, 285 R, 152 A, 285 A, 284, 152 R

[56] References Cited

U.S. PATENT DOCUMENTS 2,012,694 8/1935 Runyan ..... 241/275 X 2,609,993 9/1952 Planiol ..... 241/275 X 3,970,257 7/1976 MacDonald et al. ..... 241/275

FOREIGN PATENT DOCUMENTS 33785 9/1978 Japan .

*Primary Examiner*—Mark Rosenbaum

*Attorney, Agent, or Firm*—Wegner & Bretschneider

[57] ABSTRACT

In a centrifugal crusher including a rotor rotating at high speed for receiving a supply of material to be crushed, and a crushing chamber enclosing the rotor, the material is thrown out of the rotor in a tangential direction by centrifugal forces into collision with a dead-bed constituted by particulate material stacked in a heap in the crushing chamber after being produced by crushing the material. The particulate material brought into collision with the dead-bed is allowed to stay in the crushing chamber for a period of time long enough to serve as a dead-bed for crushing the particulate material into particles of a desired particle size, before being discharged continuously or periodically from the crushing chamber.

9 Claims, 2 Drawing Figures

METHOD OF WITHDRAWING PARTICULATE MATERIAL FROM DEAD-BED OF CENTRIFUGAL CRUSHER AND CENTRIFUGAL CRUSHER SUITABLE FOR CARRYING THE METHOD INTO PRACTICE

BACKGROUND OF THE INVENTION

This invention relates to a method of withdrawing particulate material from a centrifugal crusher after the particulate material has stayed for a while in a crushing chamber of the centrifugal crusher wherein material to be crushed, such as mineral ore, is fed to a rotor rotating at high speed and is thrown by centrifugal force in a tangential direction against the surface of a dead-bed constituted by particulate material produced by crushing the material fed to the rotor and stacked in a heap in the crushing chamber around the rotor, and a centrifugal crusher of the type suitable for carrying the method into practice.

In a centrifugal crusher for crushing material thrown out of the rotor by centrifugal forces, it has hitherto been usual practice to use a rebound plate of high rigidity against which the material to be crushed is thrown by centrifugal forces. This type of centrifugal crusher of the prior art has suffered the disadvantage that wear is readily caused on the rebound plate because of high impact applied thereto by the material to be crushed. Proposals have been made in recent years to use a centrifugal crusher of the type in which a dead-bed constituted by particulate material produced by crushing material fed to the rotor is used in place of the rebound plate. This type of centrifugal crusher is free from the aforesaid disdvantage of the centrifugal crusher using a rebound plate and has a high practical value. However, the centrifugal crusher now available which relies on a dead-bed is not without disadvantages. One of them is that the material to be crushed impinges on the dead-bed and is crushed thereby into particulate material which scatters and moves downwardly to be released from the crusher. The kinetic energy possessed by the material to be crushed which is thrown out the rotor by centrifugal force should be used for crushing the material itself and for crushing the particulate material constituting the dead-bed into still smaller particles. However, in the centrifugal crusher using the dead-bed which is non available, the energy directed against the dead-bed is wasted because it is absorbed by the dead-bed, without contributing to further crushing of the particulate material of the dead-bed into smaller particles.

SUMMARY OF THE INVENTION

This invention has been developed for the purpose of obviating the aforesaid disadvantages of the prior art. Accordingly the invention has as its object the provision of a method of withdrawing particulate material from a dead-bed of a centrifugal crusher while making effective use of the kinetic energy possessed by the material thrown by centrifugal force against the dead-bed and crushed into particulate material by causing the particulate material to stay in the centrifugal crusher for a period of time long enough to serve as a dead-bed for crushing the particulate material into still smaller particles, and a centrifugal crusher of the type suitable for carrying such method into practice.

The outstanding characteristic of the invention is that means is provided, in a centrifugal crusher comprising a rotor formed at its outer periphery with discharging ports which is rotatable high speed, and an annular crushing chamber enclosing the rotor, wherein material to be crushed, such as mineral ore, is fed to the rotor and thrown by centrifugal forces in a tangential direction through the discharging ports of the rotor against a dead-bed constituted by particulate material stacked in a heap in the crushing chamber, for continuously or periodically releasing a portion of the particulate material constituting the dead-bed from the crushing chamber while causing the particulate material produced by collision with the dead-bed to stay in the crusing chamber for a period of time long enough to serve as a dead-bed for further crushing the particulate material into still smaller particles.

DESCRIPTION OF THE PREFERRED EMBODIMENTS

Preferred embodiments of the invention will be described by referring to the accompanying drawings.

Figure 1:
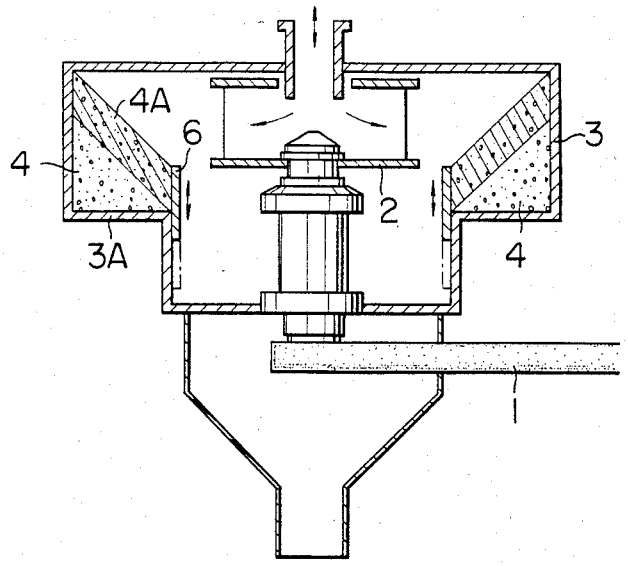
FIG. 1 is a view in explanation of the centrifugal crusher comprising one embodiment of the invention, suitable for carrying the method according to the invention into practice.

FIG. 1 shows one embodiment of the centrifugal crusher in conformity with the invention comprising a belt 1, a rotor 2 connected by the belt 1 to a motor (not shown) for rotation at high speed, and a crushing chamber 3 of an annular shaped surrounding the rotor 2. Material to be crushed, such as mineral ores, is fed to the rotor 2 and thrown by centrifugal forces from the rotor 2 through a plurality of discharging ports formed at its outer periphery to fly in a tangential direction, so that the material will impinge on a dead-bed 4 constituted by particulate material crushed and stacked in a heap around the rotor 2 in the crushing chamber 3. The material impinging on the dead-bed 4 is crushed by collision with the dead-bed 4 into particulate material which is made to stay as a dead-bed for a period of time long enough to crush the particulate material into still smaller particles, before being released from the crushing chamber. The particulate material may be discharged from the crushing chamber either continuously or periodically. FIG. 1 shows, as means for discharging the particulate material periodically, a partition plate 6 of a cylindrical shape mounted for vertical movement, so that the partition plate 6 can be moved up and down periodically by suitable actuating means, not shown.

The partition plate 6 is preferably set to move between an upper position in which it is not hit by the material thrown out of the rotor 2 but still extends above the level of floor plate 3A and a lower position in which the partition plate 6 is at the same height as the floor plate 3A of the crushing chamber 3. Normally, the partition plate 6 is disposed in the upper position.

The material thrown out of the rotor 2 by centrifugal forces is crushed by collision with the surface of the dead-bed 4 to produce particulate material which is further crushed into still smaller particles by collision on the surface of the dead-bed 4 with the material thrown out of the rotor 2, to form a stack of particulate material piled in a heap on the surface of the dead-bed 4. When the lower end of the surface of the dead-bed 4 reaches the upper end of the partition plate 6 as shown in FIG. 1, for example, the partition plate 6 is moved downwardly, so that the heap of particulate material is broken up at the upper layer of the dead-bed 4 and the surface of the dead-bed 4 moves downwardly. When the partition plate 6 reaches the same level as the floor 3A, the downward movement of the surface of the dead-bed 4 stops. By this time, a hatched portion of the dead-bed 4 designated by the reference numeral 4A has been discharged from the crushing chamber 3. When the downward movement of the surface of the dead-bed 4 has stopped, the partition plate 6 begins to move upwardly again until it reaches the upper position.

In the embodiment of the centrifugal crusher shown in FIG. 1, the partition plate 6 is moved vertically to discharge the particulates material produced by crushing the supplied material periodically. However, the invention is not limited to this specific means of discharging the particulate material, and the floor plate 3A may be moved vertically to move the dead-bed 4 upwardly when the floor plate 3A moves upwardly, to thereby discharge the particulate material constituting the upper layer of the dead-bed 4. Air ports may be formed in an upper portion of the crushing chamber 3 to blow air currents in jet streams therethrough, to blow the particulate material constituting the upper layer of the dead-bed 4, to discharge same from the crushing chamber 3.

Figure 2:
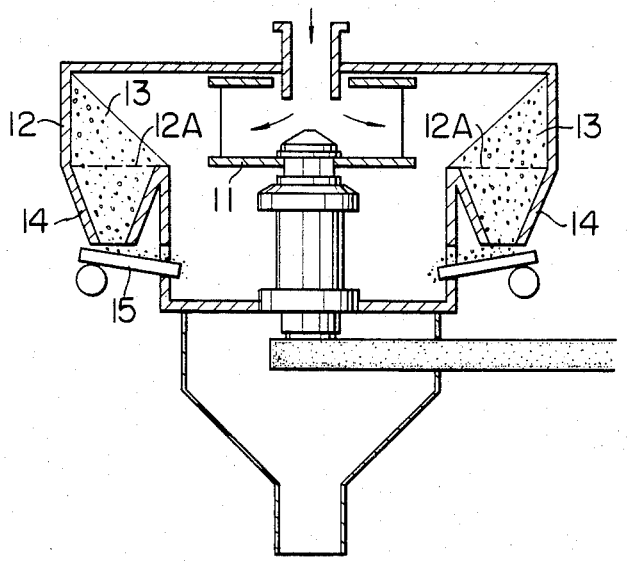
FIG. 2 is a view in explanation of the centrifugal crusher comprising another embodiment, suitable for carrying the method according to the invention into practice.

FIG. 2 shows another embodiment of the centrifugal crusher in conformity with the invention intended to discharge particulate material continuously as the material supplied to a rotor 11 is crushed in a crushing chamber 12. The crushing chamber 12 surrounding the rotor 11 has a floor plate 12A which is formed with discharging ports of a suitable diameter at regular intervals (in FIG. 2, the floor plate 12A is not shown). A chute 14 is provided below each of the discharging ports to discharge the particulate material constituting the lower layer of a dead-bed 13 by means of a vibration feeder 15.

The volume of particulate material discharged from the crushing chamber can be controlled by adjusting the number or amplitude of vibration of the vibration feeder 15 or the gap between the lower end of the discharging port and the chute. If the volume of discharged particulate material is reduced, then the period of time the particulate material stays in the crushing chamber to constitute the dead-bed is prolonged and the opportunities of collision with the material thrown out of the rotor increase so that the particulate material thrown out of the rotor increase so that the particulate material can be crushed into particles of smaller size. Conversely when the volume of particulate material discharged from the crushing chamber increases, then the grain size of particulate material discharged from the crushing chamber becomes larger. Thus the maximum volume of particulate material to be discharged is set at a level such that the dead-bed 3, 13 will exist to enable satisfactory crusing of the material thrown out of the rotor to be achieved. Ideally the volume of particulate material discharged from the crushing chamber should be equal to the volume of material fed to the rotor 2, 11. Thus the material thrown out of the rotor by centrifugal forces and crushed into particulate material all constitutes a dead-bed. In actual practice, however, some particulate material scattered after being produced immediately moves downwardly, to be discharged from the crusing chamber. Thus the maximum volume of particulate material discharged through the discharging ports will be the volume of material fed to the rotor minus the volume of particulate material moving downwardly without consituting a dead-bed.

In the centrifugal crusher according to the invention, it is possible to produce particulate material of a desired grain size by controlling the volume of particulate material discharged from the crusher.

In the embodiment shown and described hereinabove, the discharging ports have been described as being formed at regular intervals in the floor plate 12A. However, a discharge opening of an annular form may be formed along the entire outer periphery of the floor plate 12A or the floor plate formed with (at least one discharging port) may be rotated to enable the particulate material to be uniformly discharged from the outer periphery. In this case, the chute 14 and vibration feeder 15 are also provided in the form of a ring.

In place of discharging the particulate material by means of the vibration feeder described hereinabove, the particulate material may be discharged from the lower end portion of the chute without using the vibration feeder, or the particulate material may be allowed to move downwardly through the discharging ports by its own weight. In this case, a damper may, for example, be attached to a lower end portion of the chute or to the discharge port, to enable the volume of discharged particulate material to be controlled by adjusting the degree of opening of the damper.

From the foregoing description, it will be appreciated that in the centrifugal crusher according to the invention, material thrown out of the rotor by centrifugal forces is crushed by collision with the dead-bed constituted by particulate material stacked in a heap and part of the particulate material thus produced is continuously or periodically discharged from the crusher while the rest is allowed to stay in the crusher for a period of time long enough to serve as a dead-bed for further crushing the particulate material into still smaller particles. Thus the kinetic energy possessed by the material thrown out of the rotor is used not only for crushing the material itself but also for crushing the particulate material constituting a dead-bed into particles of still smaller size, so that the particulate material of the desired particle size can be discharged from the crusher. The kinetic energy imparted to the dead-bed can be used effectively without being wasted.

What is claimed is:

1. A method for crushing material, comprising:

feeding material to be crushed to a rotor within and spaced from an annular crushing chamber;

throwing said material tangentially from said rotor by centrifugal force to collide with a dead-bed of particulate material in the crushing chamber;

retaining said thrown material in the crushing chamber for a time period sufficient so that said thrown material serves as a dead bed for further material thrown from said rotor and is crushed further by said further thrown material; and discharging said thrown material after said retaining step, substantially all of the material thrown from the rotor being subjected to said retaining step.

2. The process of claim 1, wherein said discharging is periodical.

3. The process of claim 1, wherein said discharging is continuous.

4. A centrifugal crusher, comprising:

a rotor having a plurality of discharge ports;

an annular crushing chamber having a rotatable floor, surrounding and spaced from said rotor;

means for feeding material to be crushed to said rotor, said rotor throwing said material tangentially into said crushing chamber by centrifugal force;

a dead bed of particulate matter in the crusher chamber against which said thrown material collides;

means for collecting said thrown material as part of said dead bed; and discharge means comprising an opening in said rotatable floor for discharging thrown material from said dead bed at a rate so that said thrown material is retained as part of said dead bed so that said thrown material is crushed further as the upper layer of said dead bed by further material thrown from said rotor.

5. The crusher of claim 4, wherein said discharge means is a plurality of regularly spaced ports in said crusher chamber.

6. The crusher of claim 5, further comprising a chute for each crusher chamber port and a vibration feeder below and suitably spaced from each chute.

7. The crusher of claim 4, wherein said discharge means is a single annular opening.

8. The crusher of claim 4, further comprising means for controlling the volume of material discharged from the crusher.

9. The crusher of claim 8, wherein said means for controlling comprises an adjustable damper.

* * * * *